United States Patent [19]

Bruggi

[11] 4,324,118

[45] Apr. 13, 1982

[54] MACHINE FOR ROUGHING A PERIPHERAL VAMP EDGE OF A SHOE

[76] Inventor: Mario Bruggi, Corso Torino, 114 Vigevano (Pavia), Italy

[21] Appl. No.: 21,203

[22] Filed: Mar. 16, 1979

[30] Foreign Application Priority Data

Mar. 17, 1978 [IT] Italy ..... 21322 A/78

[51] Int. Cl.[3] ..... A43D 37/00; C14B 1/44

[52] U.S. Cl. ..... 69/6.5; 12/1 R; 12/17 R; 51/DIG. 13; 51/35

[58] Field of Search ..... 69/6.5, 1; 12/1 R, 17 R; 51/DIG. 13, 35

[56] References Cited

U.S. PATENT DOCUMENTS

| | | | |
|---|---|---|---|
| 3,518,851 | 7/1970 | Boot et al. | 69/6.5 |
| 3,559,428 | 2/1971 | Babson | 69/6.5 |
| 3,645,118 | 2/1972 | Babson | 69/6.5 |
| 3,733,632 | 5/1973 | Bechtold | 12/1 R |
| 3,831,405 | 8/1974 | Vornberger | 69/6.5 |
| 3,843,985 | 10/1974 | Leonhardt | 12/1 R |
| 4,090,378 | 5/1978 | Sommer | 69/6.5 |

*Primary Examiner*—James Kee Chi
*Attorney, Agent, or Firm*—Karl F. Ross

[57] ABSTRACT

A turntable rotatable about a vertical axis X supports a carriage slidable thereacross; two templates, with profiles respectively conforming to those of a pair of shoes whose uppers or vamps are to be roughened along a peripheral edge folded about an insole, are part of a stack which is mounted on the carriage and is releasably coupled with a shaft journaled in an overhanging, horizontally movable beam. The shaft carries a base frame of a shoe-supporting unit with heel and toe clamps for gripping a shoe whose vamp is to be roughened and which alignedly overlies the corresponding template; this template is contacted by a feeder which is carried on the free end of a horizontally swingable arm also supporting a rotary roughening brush whereby the latter follows the motion of the feeler during translatory shifts of the carriage and 180° rotations of the turntable to work the entire peripheral vamp edge of the shoe. The brush-supporting arm further carries a grinding wheel serving to sharpen the rotating brush.

14 Claims, 10 Drawing Figures

MACHINE FOR ROUGHING A PERIPHERAL VAMP EDGE OF A SHOE

FIELD OF THE INVENTION

The object of the present invention is a machine suitable to produce, by means of a brush mill, the necessary surface roughness along the whole peripheral edge of shoe vamps, and more precisely on the vamp edge folded under the shoe last on which the vamp is shaped, in order to improve the glueing of the sole.

BACKGROUND OF THE INVENTION

Many types of milling machines are known, employing brush mills, to roughen suitably the edges of vamps folded under the shoe sole; some types employ a couple of rotating brush mills, which can be applied transversely to the two opposite longitudinal edges of the vamp, and between them the vamp on the shoe last is transported. These types of machines are not always suitable to produce the roughness on the toe and on the heel, so that after the working on the machine, the shoe must be submitted to further finishing operations.

Other, more recent and complex machines employ a single brush mill, mounted on supports which can move transversely to the shoe to be worked, and controlled by copying mechanisms following the shape of the shoe being worked; with these solutions, the shoe is held by supports which can move axially in both directions and swivel on a horizontal plate in such a way as to offer to the action of the mill both the opposite peripheral edges and the curved sections of the toe and the heel.

In general, all the known machines have disadvantages and limitations of use: as matter of fact often the roughness is not uniformly distributed along the whole peripheral edge especially when the folded edge is creased, and when the skin is particularly delicate. Furthermore, these machines are affected by limitations in the depth (width) of the milled zone and in the constancy of such width, and they do not allow variations of the width of the roughened zone, if necessary, in particular parts of the shoe, because the copying mechanisms which guide the mill follow the shoe last on which the shoe vamp is fitted, without possibility of varying, if necessary, the depth or width of certain critical zones of the vamp edge.

It is therefore an objective of the present invention to realize a machine of the aforementioned type, improved to overcome the disadvantages and limitations of the known milling machines, and in particular, a machine fitted with devices and mechanisms improved in such a way as to obtain peripheral edges of uniform roughness and wanted width, whatever is the size of the shoe, its shape and the type of skin of the vamp.

Another objective of the invention is to realize a milling machine operating in a completely automatic fashion, and offering constancy and regularity of working such as to exclude any successive manual finishing operation.

Such objectives are profitably obtained by a milling machine for the roughening of the edges of a shoe vamp folded under the sole of the shoe, employing a brush mill, driven by its own electric motor and mounted on a swinging counterweighted arm, such machine comprising, according to the invention: a base plate on which is fitted up a first vertical column carrying a horizontal swiveling arm to whose extremity a movable and horizontally displaceable plate is hinged; a shoe carrying unit being able to rotate, on said plate, and movable with it, and consisting of adjustable supports for the holding and fastening of the shoe in upside down position, and of couples of clamping lugs for sideway clamping of the shoe, constituted by rods which can be moved apart by hydraulic cylinders fixed to said plate; said machine comprising a second upright supporting a curved arm rotating in a horizontal plane, fitted at one extremity with a bracket supporting the oscillating arm of said brush mill with relative motor and counterweight, such arm being coupled to two hydraulic cylinders one of which creates the necessary pressure of the brush on the edge of the shoe and the other controls at the start the approaching of the arm and gives the signal for starting the movement of the shoe carrying unit; a rod shaped feeler, with horizontal axis, hinged on said bracket carrying the brush-counterweight-motor unit, and in contact with two templates one with the profile of a right shoe and the other with the profile of a left shoe, placed on the same axis of the shoe carrying unit and connected to the movable plate supporting the same shoe-carrying unit, by means of a frontal coupling, which can be opened by a hydraulic cylinder suitable to raise said movable plate and the shoe carrying unit to allow for the substitution of the templates; a hydraulic cylinder acting on said brush carrying arm, and suitable to keep constantly the said feeler in contact with the said templates, during the milling, thereby allowing the rotating brush to follow the profile of the shoe; a carriage movable in the two directions parallel to the longitudinal axis of the shoe, by means of a horizontal hydraulic cylinder which can displace said movable plate and the relative shoe carrying unit, so as to keep the edge of the shoe always in contact with said brush mill; a plate fixed to said carriage controlling hydraulic cylinder, rotating on a vertical axis by means of a hydraulic motor with relative transmission and reduction gears, capable of rotating of 180° the carriage, the template and shoe carrying units, at the end of each movement of the carriage in the two directions, thus allowing the brush to roughen the curved edge of the toe and heel respectively, provision being made for a decelerating valve with a cam associated to said gears driven by the hydraulic motor, in order to obtain the automatic stopping of the rotating plate, at the end of the 180° rotation, and provision being also made for a hydraulic rotating distributor, on the same axis of the rotating plate, for supplying fluid in pressure to the various hydraulic cylinders of the machine.

More in particular, said feeler can be reduced in length by means of a hydraulic cylinder, in order to allow a greater feed of the rotating brush towards the central zone of the shoe thereby obtaining, through two complete revolutions of the revolving plate, two millings, an inner and a peripheral one, on the same shoe. Furthermore, in order to have a constant sharpening and cleaning action on the rotating brush, on the support of the oscillating, counterweighted arm of the brush, a grindwheel actuated by its own motor is mounted, which can be raised and brought close to the same brush, by means of a hydraulic cylinder.

The functional and construction characteristics of the machine object of the invention are in the following described more in detail, referring to the attached drawings, which are just indicative and not limitative, and in which.

Figure 2:
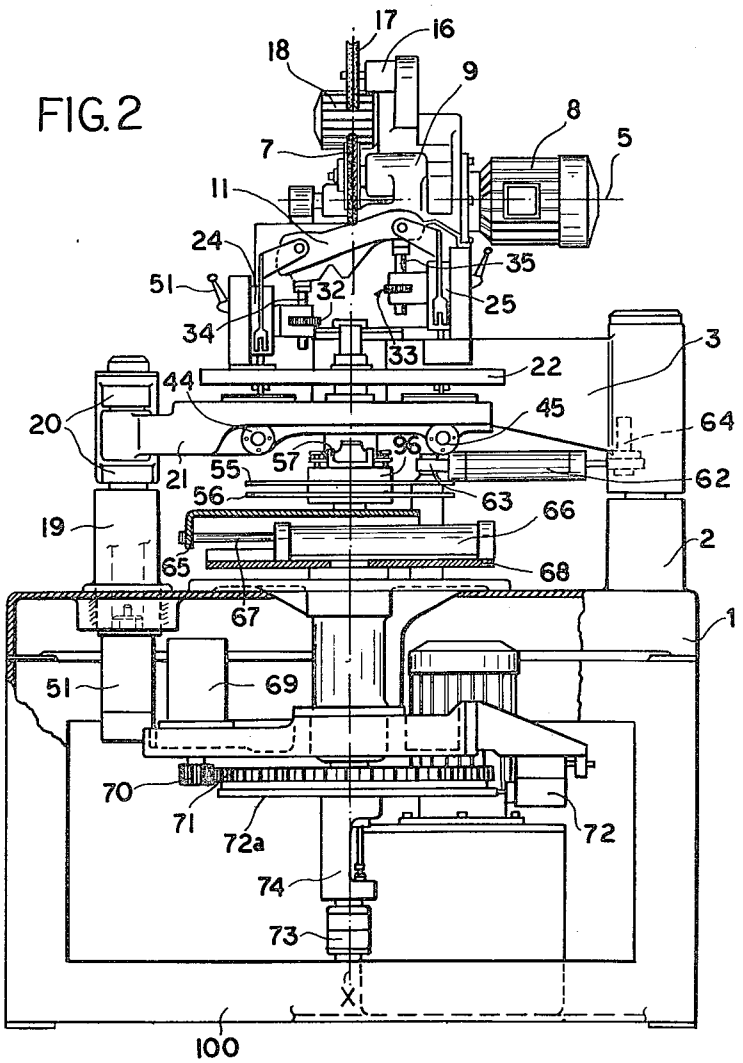
FIG. 2 shows a front view along the lines II—II of FIG. 1 of the same machine.
Figure 1:
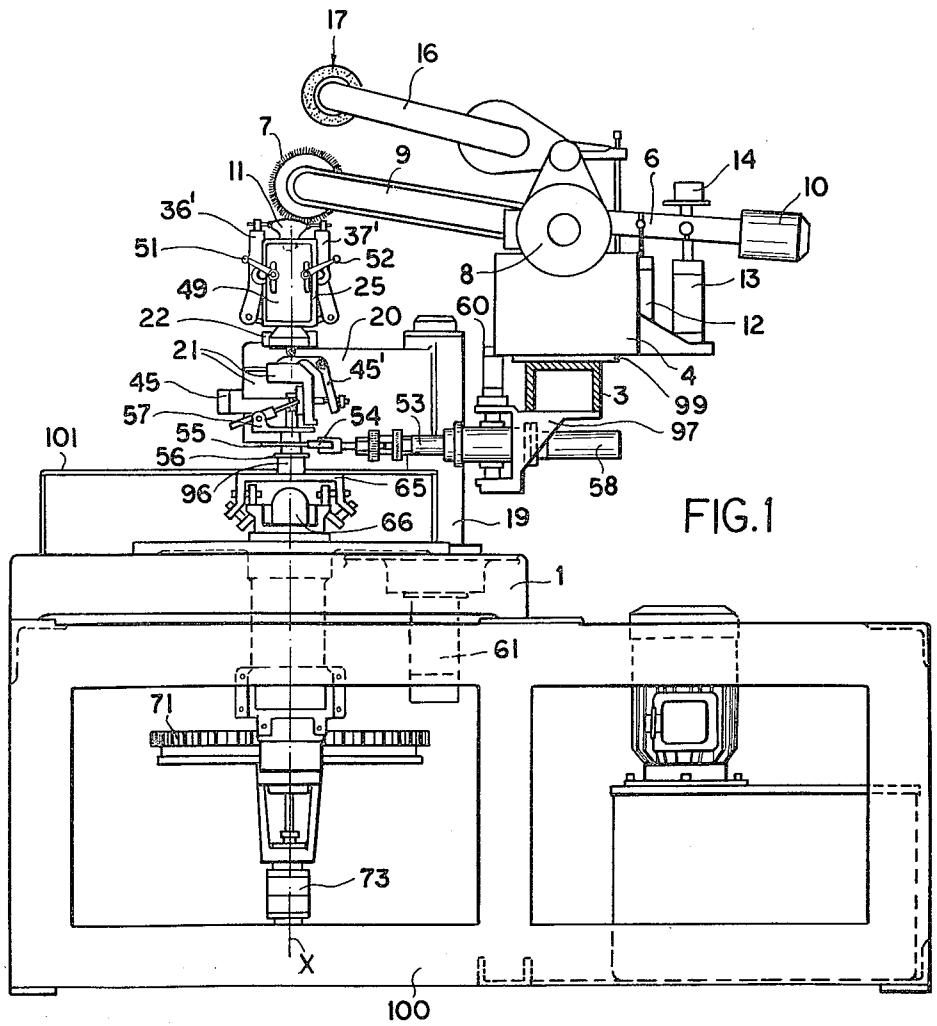
FIG. 1 shows a side view of a machine realized according to the invention.
Figure 3:
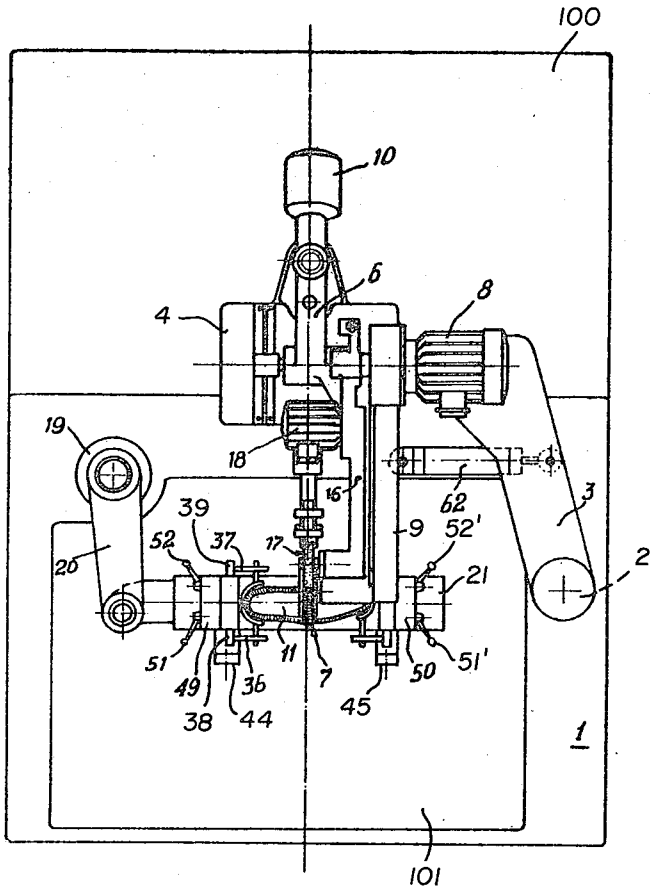
FIG. 3 shows a view of the plan (from above) of the machine of the previous figures.
Figure 4:
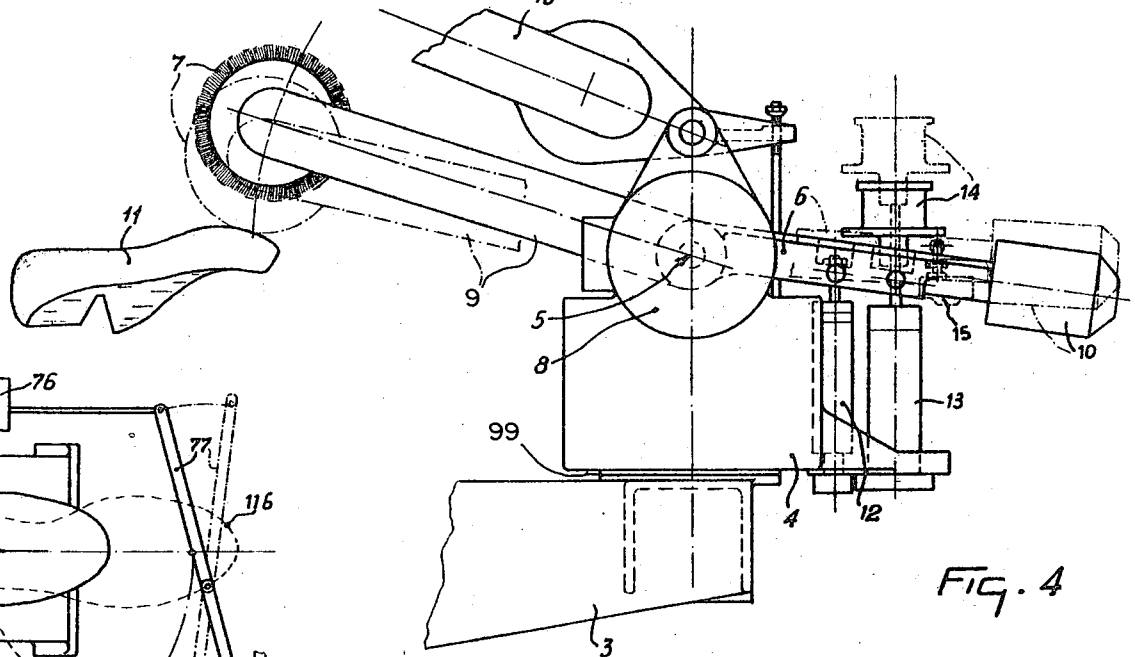
FIG. 4 shows, a side view of the upper part of the machine of FIG. 2, in larger scale.
Figure 6:
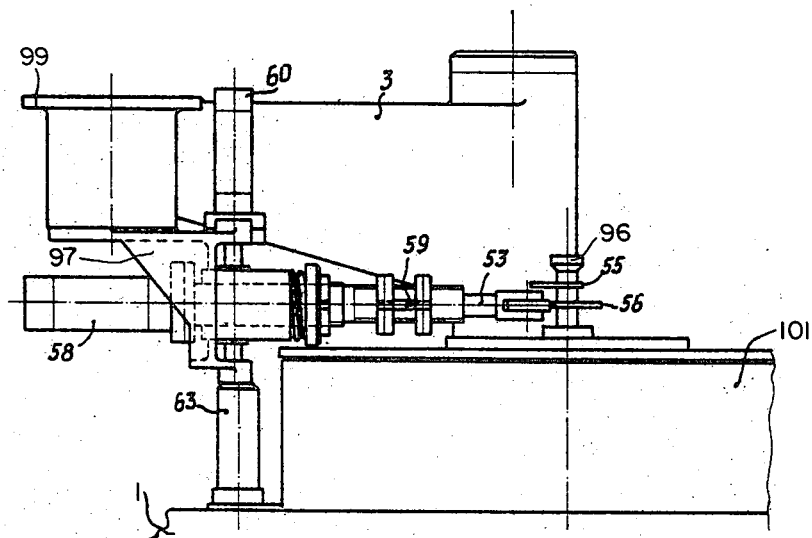
FIG. 6 shows a side view along the lines V—V of the particular of FIG. 5.
Figure 5:
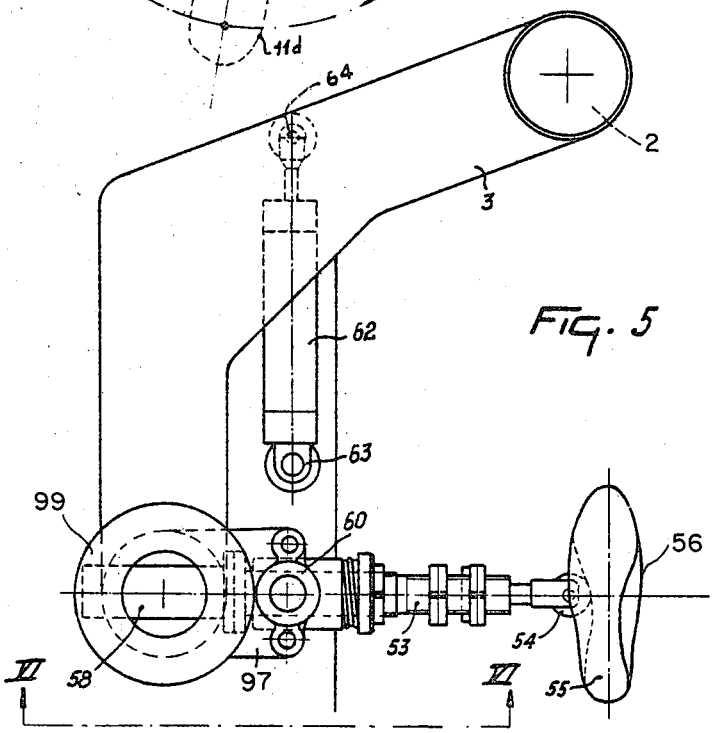
FIG. 5 shows the plan view of a particular of the machine, and precisely the feeler arm.

With reference to such figures and in particular to FIGS. 1–2 and 3 the machine object of the invention consists of a supporting box frame. On this a baseplate 1 is fixed, which on a side supports a column 2, with vertical axis, on which swivels, overhanging, a curved arm 3 to whose free extremity a bracket unit 4 is coupled (FIGS. 4–5–6).

On top of block 4 an arm 6 is mounted, oscillating around a horizontal axis 5 and supporting at one extremity a rotating brush mill, which is driven by its own electric motor 8 by means of pulleys and transmission belt 9 (FIG. 1), while at the other extremity of the arm a counterweight 10 is supported, suitable to balance the weight of the rotating brush, the latter being slightly prevailing. In FIG. 4 the brush carrying unit is shown in full line, in raised position relatively to the shoe 11 and, in dashed line, in contact with the shoe. Between the bracket 4 and the oscillating arm 6 a hydraulic cylinder 12 is inserted, which creates the necessary contact pressure on brush 7 and on one side there is another hydraulic cylinder 13 whose shaft has a stroke longer than the previous one, and follows at constant velocity the brush up to its contact with the shoe, thus giving the signal for starting the motion of the shoe carrying unit, by means of a microswitch 15 mounted on the same arm.

The shaft with contact 14 continues its stroke until it leaves the arm completely free in its working movements.

With this device, any need of adjustment of the brush, due to variations in height for changement of the shoe, is avoided.

On the bracket 4 there is an oscillating, overhanging arm 16 to whose extremity a grinding wheel 17 is fitted; this is actuated by its own motor 18, and its scope is to sharpen the rotating brush. The raising and lowering movements of the grinding wheel relative to the brush are obtained by means of a hydraulic cylinder (not shown) embodied in the bracket unit 4.

On the base plate 1 a second upright is fixed, and on its top an arm 20 is hinged, rotating horizontally and supporting a plate 21, substantially of C shape cross section (FIG. 1); this plate undergoes a translatory motion in both directions, perpendicularly to the vertical plane containing the rotating brush 7.

On the movable plate 21 the shoe carrying unit is mounted, which consists of a base frame 22 rotating on the plate 21 on a shaft 23.

Figure 7:
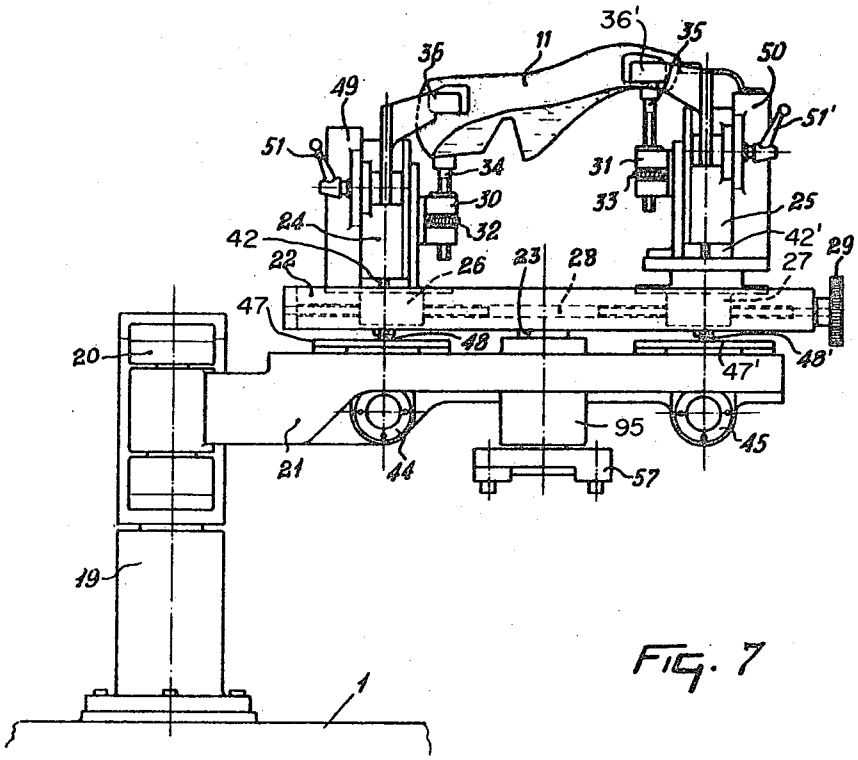
FIG. 7 shows enlarged the particular of the shoe carrying unit support arm, of FIGS. 1 and 2.
Figure 8:
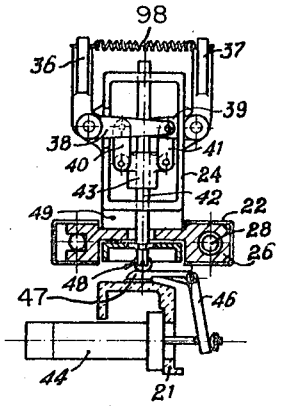
FIG. 8 shows, partly in view and partly in section, the shoe carrying unit of FIG. 7, rotated of 90°.

On said plate, box shaped elements 24 and 25 are mounted, which serve as supports of the shoe 11. Said elements can be adjusted in height on the supports 49 and 50 which are fitted with two slides 26 and 27 (FIG. 8) which run within the base frame 22 driven by a screw 28 with the thread split in two parts, with opposite pitch, each one being engaged in a nut enclosed in the slides (FIGS. 7 and 8).

An external knob 29 thus allows to displace said elements 24–25 and to adjust them simultaneously on the basis of the shoe length. The shoe 11 is supported, in upside down position, by the small brackets 30 and 31, independent of the box elements 24 and 25 and adjustable in height by means of screws 32 and 33 (FIG. 7).

A threaded rod 34 and a support 35 overhang from the small brackets 30 and 31, in order to support the heel and the toe.

On each box shaped element 24 (and 25) there are two lateral clamping lugs 36 and 37 for the shoe, hinged on a system of rods 38 and 39 and relative connecting rods 40–41; the rod system is activated by a central rod 42 vertically movable, and such as to move apart and close the clamping lugs 36–37 so that the shoe is fastened laterally both near the heel and near the toe. The opening of the lugs can be adjusted using the rod 42 sliding in the block 43 where it can be locked at different heights by means of a hand controlled screw.

The vertical displacement of rod 42 for the opening of the lugs is obtained by means of two hydraulic cylinders 44 and 45, fixed to plate 21, whose piston acts on a lever 46, at the end of which there is a plate 47 (one for each box shaped element 24–25) which pushes on the lower extremity of rod 42, fitted with the small wheel 48. The opposite lugs 36–37 of each box shaped element are pressed by a spring 48*a* (FIG. 8) which therefore exerts the closing pressure on the shoe.

Furthermore, to the elements 24 and 25 the plates 49 and 50 are associated, which allow the adjustment of the lugs by means of a couple of screws with control knobs 51–52.

To the free extremity of arm 3, supported by column 2, a feeler 53 is hinged (FIGS. 5–6), rod shaped, and ending at the free extremity with a roll 54 which must be in contact and therefore copy successively the profile of two templates 55 and 56 having respectively the profile of the peripheral edge to be roughened, of a right and a left shoe; the templates 55 and 56 are coaxial and one above the other; they are solid mounted with the movable plate 21 and aligned with the rotation axis of the shoe carrying unit by means of a frontal coupling 57. The feeler element 53 can be telescopically shortened, by means of a hydraulic cylinder 58, down against a limit switch 59 (FIG. 6) in such a way as to allow, if necessary, a longer stroke of the brush 7 towards the middle of the shoe, by effect of a larger rotation of the arm 3 towards the templates, and therefore allowing the working of a larger strip on the shoe, as will be explained in the following.

Furthermore the feeler 53 is moved in a vertical plane by means of a hydraulic cylinder 60 in order to let the feeler roller come in contact with one or the other template.

In order to substitute the template unit 55–56, in column 19 a hydraulic cylinder 61 is enclosed, which can raise, both the movable plate 21 with arm 20, and the whole shoe carrying unit, so that the frontal coupling which connects the templates to the movable plate 21, may be disengaged.

To keep the feeler 53 constantly in contact with the templates (and therefore to allow the brush 7 to follow the profile of the shoe edge when plate 21 moves transversely to the same brush) a hydraulic cylinder 62 is fixed in 63 on the base plate, and hinged in 64 on the rotating arm 3.

On the other hand, to allow the movement of the plate 21 in perpendicular direction, and in the two ways, relative to the vertical plane containing brush 7, provision is made of the carriage 65, connected to the template block and shifted alternatively by the shaft 67 of a horizontal hydraulic cylinder 66.

Cylinder 66 is fixed to a rotating plate 68 which is rotated, at the end of path of carriage 65 in both ways, by a hydraulic motor 69 by means of a couple of gears 70–71. As the rotating plate 68 must allow 180° rotations to the carriage 65 and the shoe carrying unit, in order to expose to the brush the shoe edge opposite to that already been worked, and stop the rotation at said angle, provision is made of a decelerating valve 72 controlled by a cam 72*a* connected to a toothed wheel 71, which can stop the hydraulic motor 69 at an exact 180° rotation angle of the plate. Finally, provision is made of a rotating hydraulic distributor 73 coaxial to the rotating plate, suitable to supply fluid in pressure to the various rotating hydraulic cylinders, and mounted on an axial support 74.

The machine works as follows, keeping in mind also FIGS. 9 and 10: with the machine not in operation, that is, with the brush 7 raised and the shoe lugs 36 and 37 opened, a shoe last with vamp 11 is placed on the vertical supports 34 and 35, then, by means of the hydraulic cylinder 44, rod 42 is lowered, which through levers 38–39 and 40–41 closes lugs 36 and 37 on the shoe sides locking them by means of the spring 48*a*.

The feeler roller is brought in contact with the template acting on cylinder 62, so that a switch associated to the feeler starts the movement of cylinders 12 and 13. Then the motors of brush 7 are started, and, if necessary, the grinding wheel 17, then it is the turn of cylinder 12 which brings the brush close to the shoe and simultaneously actuates the adjusting cylinder 13, which therefore, displacing its shaft vertically, brakes the descent of the brush and lays it gently on the shoe edge. At the instant of contact between the brush and the shoe the shaft of the cylinder 13 actuates, through a microswitch, the horizontal cylinder 66 which thus starts moving the carriage 65.

Figure 9:
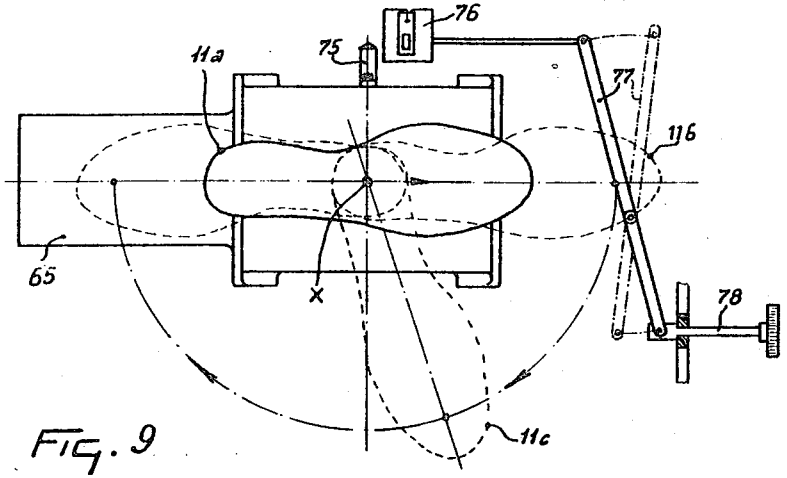
FIGS. 9 and 10 show, schematically in plan view, the successive positions of the shoe relative to the brush during and after the axial displacements in both directions, and during the rotation of the supporting plate.
Figure 10:
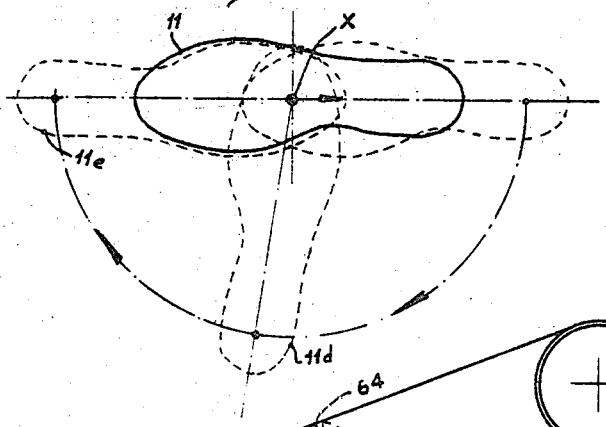

The shoe is therefore displaced (together with the carriage and the templates, from left to right, for example (FIG. 9), passing from position 11*a*—full line—to position 11*b*—dashed line—; when the shoe has reached this position 11*b* the brush has roughened a part of the peripheral edge of the shoe and therefore at this point the rotation of the plate 68 must occur to allow the working of the heel (FIG. 9).

Therefore at the end of path towards the right, as in the example chosen, a feeler 75 hanging from the carriage, pushes on a microswitch 76 which actuates the hydraulic motor 69 which rotates of 180° the plate stopping it in that position by means of the cam-decelerator device 72. The microswitch 76 can be adjusted to vary the movement by means of lever 77 and connecting rod 78.

During the rotation the shoe therefore finds itself with the heel against the brush (position 11*c*) and can therefore be worked around the heel.

At the end of the rotation, the carriage 65 which has turned around the X axis of platform 68 is actuated always to the right by the hydraulic cylinder 66 (on action of a limit switch which switches the movement of the piston of cylinder 66) and in this way the brush can work the peripheral shoe edge opposite to the previous one.

At the end of the right ward run, rotation of plate 68 occurs, so that the shoe which now exposes the toe to the brush (FIG. 10), during the working takes on positions such as 11*d* and can therefore be worked around the toe edge.

At the end of the rotation the shoe takes on position 11*e* (FIG. 10) and moving again to the right, is worked on the peripheral edge initially neglected during the first movement to the right. During all the operations (displacements and rotations) the feeler 53 has copied all the periphery of a template allowing therefore the brush to work uniformly the shoe edge.

At the end of the work on a shoe, the hydraulic cylinder 60 is actuated, which brings the feeler on the other template allowing the working of the second shoe of the shoe pair, after having fastened it on the shoe carrying unit described previously.

Therefore with two 180° rotations of plate 68 a complete working of a shoe is obtained, with a single pass under the brush.

If it is required to pass the brush (for example for thinning) more on the middle of the shoe, the feeler 53 must be shortened pulling back the shaft of the hydraulic cylinder 58; in this way the arm 3 supporting the feeler-brush unit is brought closer to the templates, taking the brush more on the middle of the shoe.

To work other pair of shoes, the template unit must be replaced by other suited to the new sizes of the shoes: to this end, the hydraulic cylinder 61 is actuated, which raises the movable plate 21, and the shoe carrying unit, thus disconnecting the frontal coupling 57; the template block is therefore disengaged from plate 21 and can be removed and replaced.

What is claimed is:

1. A machine for roughening a peripheral edge of a vamp of a shoe mounted in upside-down position on a last, comprising:

a turntable rotatable about a principal vertical axis;

a carriage linearly reciprocable on said turntable;

mounting means on said carriage for removably supporting a pair of vertically spaced templates with profiles respectively conforming to those of a pair of shoes whose vamps are to be peripherally roughened;

a first and a second arm mounted on a baseplate for independently swinging about respective collateral vertical axes;

a feeler on a free extremity of said first arm positionable to contact either of said templates;

a rotary roughening brush carried on said free extremity above said feeler;

a beam hinged to said second arm above the level of said mounting means;

a vertical shaft journaled in said beam at a location remote from said second arm and provided with coupling means for releasably connecting said shaft with said mounting means;

a shoe-supporting unit mounted on said shaft above said beam and provided with clamping means for gripping a shoe to be roughened in upside-down position and in line with the corresponding template at a level within reach of said brush;

drive means for rotating said brush;

first actuating means for moving said first arm into a position of engagement of said feeler with the template corresponding to a shoe gripped by said clamping means;

second actuating means for displacing said brush relatively to said first arm for working contact with the peripheral vamp edge of the shoe gripped by said clamping means;

third actuating means for linearly reciprocating said carriage on said turntable between respective terminal positions in which the heel and the toe of the gripped shoe are substantially centered on said principal axis; and fourth actuating means operative in each of said terminal positions for rotating said turntable through 180°.

2. A machine as defined in claim 1 wherein said shoe-supporting unit comprises a base frame rigid with said shaft and provided with a pair of uprights, said clamping means comprising a pair of heel-clamping jaws adjustably supported on one of said uprights and a pair of toe-clamping jaws adjustably supported on the other of said uprights.

3. A machine as defined in claim 2 wherein said heel-clamping jaws and said toe-clamping jaws are provided with respective linkages, said beam being provided with fifth actuating means operable in a home position of said base frame to open said heel-clamping and toe-clamping jaws.

4. A machine as defined in claim 2 or 3 wherein said base frame is provided with a pair of relatively displaceable slides respectively supporting said uprights.

5. A machine as defined in claim 1, 2 or 3 wherein said second arm is provided with elevating means for raising said beam and said shoe-supporting unit to disconnect said shaft from said mounting means.

6. A machine as defined in claim 1, 2 or 3 wherein said first arm is provided with an elongate member swingable in a vertical plane, said brush being mounted at one end of said member, the other end of said member carrying a counter-weight partly balancing the weight of said brush.

7. A machine as defined in claim 6 wherein said second actuating means comprises a fluidic cylinder having a piston connected with said member near said other end thereof for lowering said brush onto the shoe.

8. A machine as defined in claim 7, further comprising a fluidically operable braking piston engaging said member near said other end thereof for controlling the descent of the brush onto the shoe, and switch means on said member operable by said braking piston upon continuing displacement thereof after a stopping of said member by contact of the brush with the shoe for starting the operation of said third actuating means.

9. A machine as defined in claim 8, further comprising an adjustable microswitch trippable by said carriage in a terminal position thereof for starting the operation of said fourth actuating means.

10. A machine as defined in claim 6, further comprising a grinding wheel mounted on said first arm above said member and provided with a drive motor for sharpening said brush during rotation thereof.

11. A machine as defined in claim 1, 2 or 3 wherein all said actuating means comprise hydraulic cylinders.

12. A machine as defined in claim 11 wherein said turntable is provided with a rotatable distributor centered on said principal axis for supplying hydraulic fluid to said third actuating means.

13. A machine as defined in claim 11 wherein said fourth actuating means additionally comprises a decelerator controlled by cam means coupled with said turntable for arresting the turntable after a 180° rotation.

14. A machine as defined in claim 1, 2 or 3 wherein said feeler comprises a telescopically foreshortenable arm carrying a template-contacting roller.

* * * * *